US005580238A

United States Patent [19]

Charles, Sr. et al.

[11] Patent Number: 5,580,238

[45] Date of Patent: Dec. 3, 1996

[54] BAFFLE FOR $NO_x$ AND NOISE REDUCTION

[75] Inventors: John G. Charles, Sr., Tyler, Tex.; Eugene D. Daddis, Jr., Nedrow, N.Y.

[73] Assignee: Carrier Corporation, Syracuse, N.Y.

[21] Appl. No.: 573,982

[22] Filed: Dec. 18, 1995

[51] Int. Cl.[6] ..... F23D 14/12

[52] U.S. Cl. ..... 431/114; 431/351; 431/347; 126/91 A

[58] Field of Search ..... 126/91 A; 431/351, 431/352, 347, 114, 171

[56] References Cited

U.S. PATENT DOCUMENTS

| | | | |
|---|---|---|---|
| 2,059,523 | 11/1936 | Hepburn et al. | 431/352 |
| 2,396,868 | 3/1946 | McCollum | 431/347 |
| 3,732,059 | 5/1973 | Goodnight et al. | 431/286 |
| 4,619,604 | 10/1986 | Pickering | 431/352 |
| 4,869,230 | 9/1989 | Fletcher et al. | 126/91 A |
| 5,049,066 | 9/1991 | Kaiya et al. | 431/352 |
| 5,240,411 | 8/1993 | Abalos | 431/329 |

*Primary Examiner*—Carroll B. Dority

[57] ABSTRACT

A spiral, perforate ceramic baffle is placed into a heat exchanger in facing relationship with the burner and in an overhung relationship to the heat exchanger. A primary air/fuel mixture in the flame from the burner passes into the baffle drawing secondary air into the overhung portion of the baffle cooling the burner flame. Turbulence of the burner flame pattern in the baffle changes heat exchanger harmonic resonance and reduces burner noise.

16 Claims, 1 Drawing Sheet

BAFFLE FOR $NO_X$ AND NOISE REDUCTION

BACKGROUND OF THE INVENTION

In the complete combustion of common gaseous fuels, the fuel combines with oxygen to produce carbon dioxide, water and heat. There can be intermediate reactions producing carbon monoxide and hydrogen. The heat, however, can also cause other chemical reactions such as causing atmospheric oxygen and nitrogen to combine to form oxides of nitrogen or $NO_x$. While $NO_x$ may be produced in several ways, thermal $NO_x$ is associated with high temperatures, i.e. over 2800° F. The flame is zoned so that different parts of the flame are at different temperatures. $NO_x$ production can be reduced with the lowering of the peak flame temperature. The reduction in $NO_x$ can be achieved through turbulence of the gases being combusted and/or by heat transfer from the high temperature portion of the flame. Another problem associated with inshot burners employed in gas appliances such as furnaces is the production of excess noise during the operation of such gas burners.

SUMMARY OF THE INVENTION

A ceramic fiber baffle is placed into a tubular heat exchanger in facing relationship with the burner such that the burner flame passes through the baffle which is of a spiral or involute shape. This configuration has the effect of making the flow path a spiral. The perforations in the spiral permit fluid communication between adjacent sections of the flow path separated by the perforate wall defining the spiral baffle. As the flame passes through the baffle, heat transfer to the tubular heat exchanger at the location of the baffle is increased which reduces flame temperature resulting in the reduction of the production of thermal $NO_x$. Additionally, the perforations in the spiral baffle cause flame turbulence which changes the harmonies in the tubular heat exchanger with a considerable reduction in noise. Preferably, the perforations or holes are uniformly spaced apart and each has an area on the order of 0.08 to 0.11 square inches and together make up 55% to 75% of the surface area of the baffle.

It is an object of this invention to provide a low flame profile and relatively low flame temperatures in existing inshot burners.

It is another object of this invention to provide an inshot gas burner assembly which operates with reduced noise and resonance.

It is a further object of this invention to reduce the production of thermal $NO_x$. These objects, and others as will become apparent hereinafter, are accomplished by the present invention.

Basically, the spiral baffle extends from the heat exchanger in facing, spaced relation with the burner head. The baffle extends through the bell orifice or flame shaper so that all of the combustion air along with the flame is drawn through the baffle. The combustion air being drawn through the baffle cools the baffle thus cooling the burner flame. As the combustion air passes through the baffle it is heated and the heat from the combustion air is used downstream in the flame to help complete combustion.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figures 1, 2:
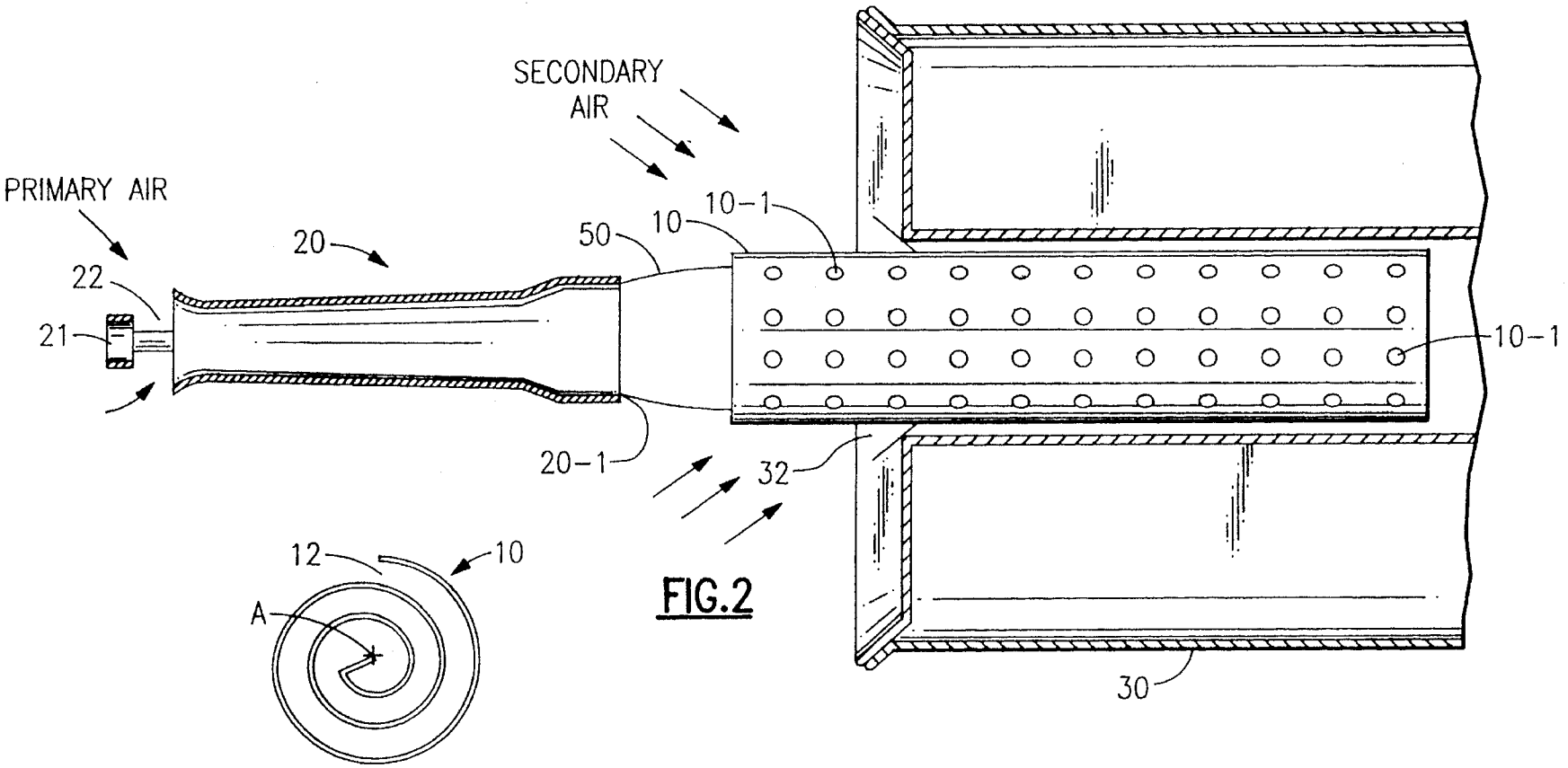
FIG. 1 is a sectional view of a burner, baffle and heat exchanger.
FIG. 2 is an end view of the baffle.

In the Figures, the numeral 10 generally designates the spiral, perforate baffle. Baffle 10 has an axis A, with a plurality of radially spaced turns defining a spiral channel or passage. Baffle 10 is preferably made of ceramic fiber, such as silicon carbide, but may be made of a high temperature alloy. Baffle 10 has a plurality of uniformly spaced perforations or holes 10-1 which are on the order of 0.08 to 0.11 square inches about 0.4 inches apart, on center, with a total porosity of 55% to 75% of the surface area of baffle 10. Baffle 10 has a nominal length of 6.0 inches and a nominal diameter of 2.125 inches. The turns of the spiral defining baffle 10 are nominally spaced 0.2 inches, 5 mm, apart.

Baffle 10 is used in conjunction with an inshot burner 20 a heat exchanger 30 of existing design. For example, the heat exchanger 10 is of tubular design. Baffle 10 is received in and supported by heat exchanger 10 such that one end extends from the heat exchanger on the order of 0.5 to 1.0 inches beyond bell orifice or flame shaper 32 and on the order of 2.0 inches from the burner head 20-1 of burner 20.

In operation, gaseous fuel is supplied under pressure to port 21 of burner 20. The gas supplied to port 21 passes annular opening 22 aspirating atmospheric air which makes up the primary air and which is drawn into burner 20. The fuel/primary air mixture exits burner 20 in flame 50 which extends into baffle 10 and heat exchanger 30 which are positioned directly in the burner's flame 50. As the flame 50 made up of the primary air/fuel mix flows axially into the spiral defined by baffle 10, secondary air is being drawn in. The secondary air performs two functions in that it cools baffle 10 as well as completing combustion of the fuel. The secondary air enters the baffle 10 axially with the primary air/fuel mixture, radially through the perforations 10-1 in the overhung portion of the baffle 10, and tangentially through the gap 12 between the outer end of the spiral and the adjacent turn in the overhung portion of baffle 10. The secondary air enters the baffle 10 due to aspiration. As the secondary air passes over the baffle 10 it cools the baffle 10. After the secondary air passes through the baffle 10 it retains enough heat from heat transfer from the baffle 10 to the secondary air to keep the flame temperature high enough to complete the combustion during the later stages. Baffle 10 also creates turbulence the burner flame pattern which changes tubular heat exchanger harmonic resonance and reduces burner noise. A major contributor to the turbulence is provided by the fluid communication between adjacent portions of the spiral flow path through baffle 10 due to perforations 10-1.

Although a preferred embodiment of the present invention has been described and illustrated, other changes will occur to those skilled in the art. It is therefore intended that the scope of the present invention is to be limited only by the scope of the appended claims.

What is claimed is:

1. A baffle for reducing $NO_x$ and changing heat exchanger harmonic resonance comprising:

a heat resistant member formed as a spiral relative to an axis with a plurality of radially spaced turns;

said member having a plurality of perforations therein providing fluid communication between regions separated by said spaced turns;

whereby when said baffle is placed in a heat exchanger opposite a burner, flow made up of a flame containing a mixture of fuel and primary air flows axially into said baffle from the burner drawing secondary air into said baffle which cools said baffle and creates turbulence thereby reducing $NO_x$ production and changing heat exchanger harmonic resonance.

2. The baffle of claim 1 wherein secondary air enters said baffle axially, radially and tangentially.

3. The baffle of claim 1 wherein when said baffle is placed in an overhung relationship to the heat exchanger secondary air enters said baffle axially, radially and tangentially in the overhung portion.

4. The baffle of claim 1 wherein said perforations make up 55% to 75% of said baffle.

5. The baffle of claim 4 wherein said perforations are each on the order of 0.08 to 0.11 square inches.

6. The baffle of claim 1 wherein said perforations are each on the order of 0.08 to 0.11 square inches.

7. The baffle of claim 1 wherein said member is made of ceramic fiber.

8. The baffle of claim 1 wherein said member is made of high temperature alloy.

9. In a combustion apparatus having an inshot burner with a heat exchanger in facing relationship with said burner the improvement comprising:

a heat resistant member formed as a spiral relative to an axis with a plurality of radially spaced turns;

said member having a plurality of perforations therein providing fluid communication between regions separated by said spaced turns;

whereby flow made up of a flame containing a mixture of fuel and primary air flows axially into said baffle from said burner drawing secondary air into said baffle which cools said baffle and creates turbulence thereby reducing $NO_x$ production and changing heat exchanger harmonic.

10. The combustion apparatus of claim 9 wherein secondary air enters said baffle axially, radially and tangentially.

11. The combustion apparatus of claim 9 wherein when said baffle is placed in an overhung relationship to the heat exchanger secondary air enters said baffle axially, radially and tangentially in the overhung portion.

12. The combustion apparatus of claim 9 wherein said perforations make up 55% to 75% of said baffle.

13. The combustion apparatus of claim 12 wherein said perforations are each on the order of 0.08 to 0.11 square inches.

14. The combustion apparatus of claim 9 wherein said perforations are each on the order of 0.08 to 0.11 square inches.

15. The combustion apparatus of claim 9 wherein said member is made of ceramic fiber.

16. In the combustion apparatus of claim 9 wherein said member is made of high temperature alloy.

* * * * *